US010738741B2

(12) United States Patent
Doyama et al.

(10) Patent No.: US 10,738,741 B2
(45) Date of Patent: Aug. 11, 2020

(54) CHARGE FORMING DEVICE WITH ADJUSTABLE VALVE LIMITER

(71) Applicant: Walbro LLC, Tucson, AZ (US)

(72) Inventors: Yoshiaki Doyama, Shiroishi (JP); Teruhiko Tobinai, Sendai (JP)

(73) Assignee: Walbro LLC, Tucson, AZ (US)

( * ) Notice: Subject to any disclaimer, the term of this patent is extended or adjusted under 35 U.S.C. 154(b) by 290 days.

(21) Appl. No.: 15/606,404

(22) Filed: May 26, 2017

(65) Prior Publication Data

US 2017/0363045 A1 Dec. 21, 2017

Related U.S. Application Data

(60) Provisional application No. 62/351,045, filed on Jun. 16, 2016.

(51) Int. Cl.

| | |
|---|---|
| ***F02M 19/04*** | (2006.01) |
| *F02M 9/00* | (2006.01) |
| *F02M 3/10* | (2006.01) |
| *F02M 9/08* | (2006.01) |
| *F02M 17/38* | (2006.01) |
| *F02M 17/08* | (2006.01) |

(52) U.S. Cl.

CPC ..... *F02M 19/04* (2013.01); *F02M 9/00* (2013.01); *F02M 9/08* (2013.01); *F02M 17/08* (2013.01); *F02M 17/38* (2013.01); *F02M 2003/105* (2013.01)

(58) Field of Classification Search

CPC ..... F02M 19/04; F02M 9/08; F02M 17/38; F02M 17/08; F02M 9/00; F02M 7/18

See application file for complete search history.

(56) References Cited

U.S. PATENT DOCUMENTS

| | | | | |
|---|---|---|---|---|
| 3,469,825 A | | 9/1969 | DuBois | |
| 3,618,906 A | | 11/1971 | Charron | |
| 5,252,261 A | * | 10/1993 | Gerhardy | F02M 3/10 137/382 |
| 5,707,561 A | * | 1/1998 | Swanson | F02M 3/10 137/382 |
| 5,984,281 A | * | 11/1999 | Hacker | F02B 63/02 137/382 |

(Continued)

FOREIGN PATENT DOCUMENTS

| | | |
|---|---|---|
| CN | 1407251 A | 4/2003 |
| CN | 1847635 A | 10/2006 |

(Continued)

OTHER PUBLICATIONS

CN Office Action for CN Application No. 201710452817.6 dated Apr. 7, 2020 (8 pages).

*Primary Examiner* — Stephen Hobson

(74) *Attorney, Agent, or Firm* — Reising Ethington P.C.

(57) ABSTRACT

A charge forming device may have a rotatable fuel adjustment valve received in a passage of a body of the device. A limiter cap may have a driving feature engageable with a drive feature on the valve and having a first position permitting rotation of the valve relative to the limiter cap and a second position permitting only lesser rotation of the valve than that of the first portion. The limiter cap may have a tamper restraint feature that retains the lesser range of rotation.

15 Claims, 9 Drawing Sheets

(56) References Cited

U.S. PATENT DOCUMENTS

| | | | | |
|---|---|---|---|---|
| 6,467,757 | B1 * | 10/2002 | Douyama | F02D 11/04 137/382 |
| 7,097,164 | B2 * | 8/2006 | Vick | F02M 3/08 137/382 |
| 7,097,165 | B1 * | 8/2006 | Braun | F02M 3/10 137/382 |
| 8,286,614 | B2 * | 10/2012 | Zbytowski | F02M 17/04 123/517 |
| 2003/0050121 | A1 | 3/2003 | Takada et al. | |
| 2012/0018908 | A1 * | 1/2012 | Kojima | F02M 7/12 261/71 |

FOREIGN PATENT DOCUMENTS

| | | | |
|---|---|---|---|
| IE | 930887 | A1 | 7/1994 |
| JP | 8312465 | A | 11/1996 |
| JP | 2003148251 | A | 5/2003 |

* cited by examiner

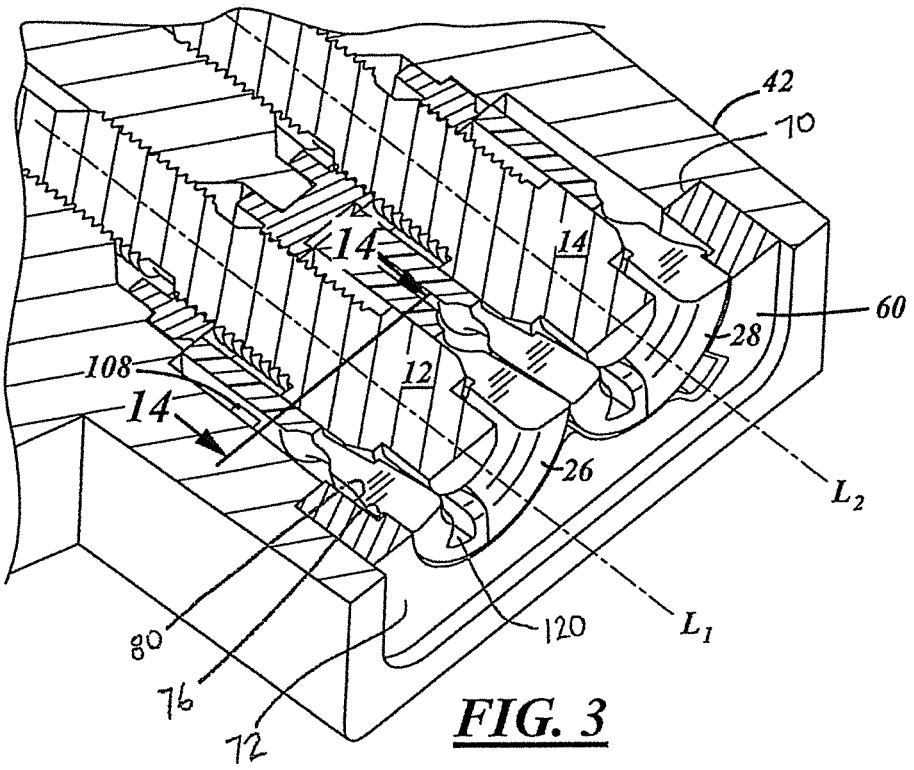
FIG. 3
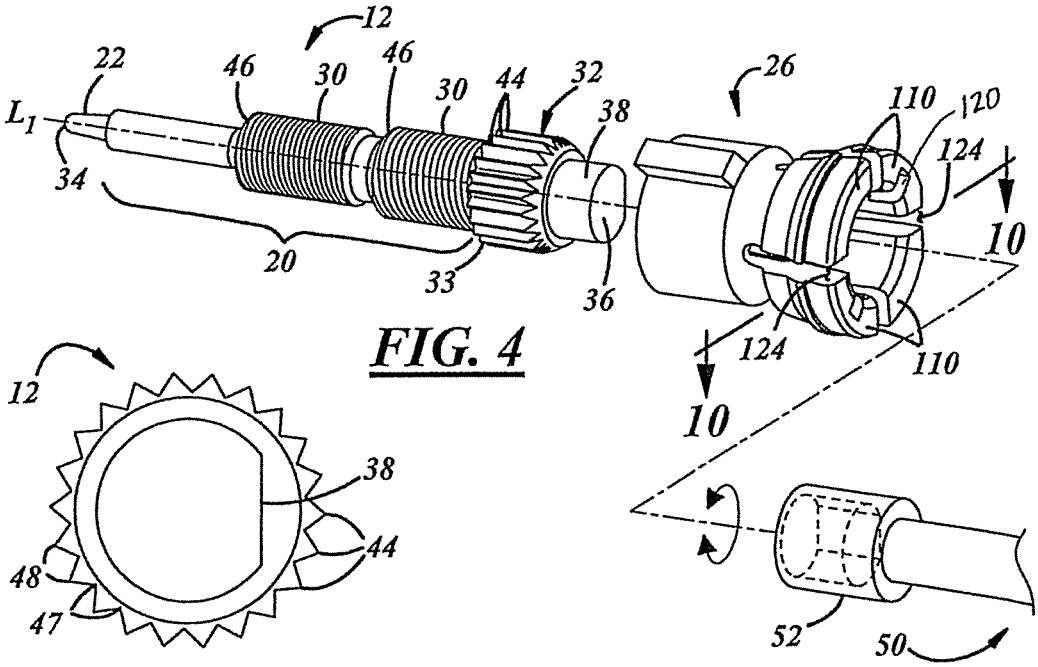
FIG. 4
FIG. 8

CHARGE FORMING DEVICE WITH ADJUSTABLE VALVE LIMITER

REFERENCE TO CO-PENDING APPLICATION

This application claims the benefit of U.S. Provisional Application Ser. No. 62/351,045, filed Jun. 16, 2016, which is incorporated herein by reference in its entirety.

TECHNICAL FIELD

The present disclosure relates generally to a fuel charge forming device for an engine such as a carburetor having an adjustable valve and a limiter for the adjustable valve.

BACKGROUND

Government agencies of an increasing number of countries are applying exhaust emission control regulations to protect the environment. These regulations are being applied to all gasoline fuel combustion engines including engines used in marine, lawn and garden and recreational equipment such as outboard motors, garden tractors, chain saws, lawn mowers, hedge trimmers, snowmobiles and personal watercraft. One means of limiting excessive exhaust emissions in a small engine is to restrict the maximum amount of fuel delivered to the combustion chamber by a charge forming device such as a carburetor. This maximum fuel amount is pre-set on each individual engine by the engine manufacturer with the understanding that the end user requires some adjustment capability to meet changing work conditions and environmental factors such as altitude and ambient temperature. The higher the altitude and temperature, the lower the air density, and thus the amount of fuel mixed with the air must be decreased to maintain the proper oxygen to fuel ratio necessary to efficiently operate the engine. The user of the engine must therefore be able to adjust the fuel to air mixture ratios and may do so via low and high speed needle valves protruding from the carburetor.

Not only is it desirable to limit the richness of the fuel-to-air mixture because of exhaust emission regulatory concerns, but the engine manufacturer of a two-cycle engine product also wants to restrict minimum amounts of fuel, or the leanness of the fuel to air mixture. Often a user will desire more power from a two-cycle engine and will attempt to operate the engine in an ultra-lean state. This will cause a two-cycle engine to operate at a temperature higher than its design temperature and may decrease its useful life and lead to service and warranty concerns. Therefore, known limiter caps are designed not only to restrict the carburetor to a maximum amount of fuel, but also to restrict the carburetor to a minimum amount of fuel.

Limiter caps secured to the projecting ends of the low and high speed needle valves are commonly used to restrict the end user from demanding too much fuel from a carburetor which could exceed regulatory emission limits. The user purchases the engine already factory set to a desired fuel amount, adequate for efficient operation in low lying areas. Should the engine be utilized in a high altitude area, the user can still decrease the amount of fuel supplied to compensate for the low air density and/or ambient temperature.

In a conventional needle valve, the valve has an enlarged metallic head having an outward end face that defines a diametric recess or slot for receipt of a tool or blade of a screwdriver to rotate the valve to adjust fuel flow. The limiter cap has a similar diametric recess or hole in an end wall for access of the screwdriver, and a continuous inner surface defining a bore for receipt of the head. The inner surface may have serrations which axially mate with serrations on the head so the limiter cap when in a user assembled state rotates in unison with the head. Typically, a peripheral side or outer surface of the limiter cap has at least one radially projecting tab which engages at least one stop of the carburetor body in both the fuel rich and fuel lean directions and thereby limits fuel adjustment capability by the end user.

Due to carburetor and engine design and manufacturing tolerances, a manufacturer's setting of a specific carburetor to an optimum fuel amount prior to use on a specific engine, or within a specific environment such as altitude, is not practical. The limiter cap assembly is therefore supplied in a non-engaged mode in which the cap is not mated to the needle valve head and is often separate from the carburetor itself. Unfortunately, supplying a carburetor with unassembled parts contributes to manufacturing or assembly inefficiencies and possible regulatory violations if the caps are never actually fully engaged to the valves.

Other needle valve assemblies, such as that disclosed in U.S. Pat. No. 6,467,757, to Douyama, and incorporated herein by reference, have a limiter cap which is pre-engaged to the carburetor body by the carburetor manufacturer for delivery to the engine manufacturer who then engages and locks the limiter cap to the valve head after final adjustments are made during operation on a specific engine. Three axially spaced projections disposed on the outer surface of the limiter cap are required to press-fit and hold the cap in the pre-engaged position and then to press-fit and lock the cap in the engaged position. When pre-engaged, the limiter cap projects outward from the carburetor body and the valve head, and the unmated serrations of the valve head are spaced axially away from the serrations of the limiter cap. When the limiter cap is pre-engaged, a screwdriver blade is inserted through the cap hole for factory rotational adjustment of the needle valve while the limiter cap is unmated from the needle valve. Upon adjustment completion, the caps are press fitted directly over the needle valve head, mating the serrations and received in the carburetor body. Once engaged to the valve head, the end user has restricted adjustment of the needle valve by rotating the limiter cap which, in turn, rotates the needle valve.

Unfortunately, during factory adjustment, if a worker employee misses the elongated hole with the screwdriver, the limiter cap may inadvertently be pushed-in axially into engagement with the needle valve head and thereby prevent factory adjustment without destroying the cap by forcibly removing it. Furthermore, the press-fit between the cap projections and the carburetor body requires that the cap be made of a resilient synthetic resin material such as nylon or other resilient thermoplastic material.

SUMMARY

A charge forming device may have a rotatable fuel adjustment valve received in a passage of a body of the device. A limiter cap may be received on the valve with a driving feature engageable with a drive feature on the valve and having a first position permitting rotation of the valve relative to the limiter cap and a second position permitting only lesser rotation of the valve than that of the first portion.

The limiter cap may have a tamper restraint feature that retains the lesser range of rotation. The tamper resistant feature may include one or more flexible fingers defining a cavity with a volume that decreases when the cap is moved to its second position to inhibit access to the valve. The cap may include a stop which in the second position limits rotation of the valve even if the fingers are tampered with or broken off and removed.

A clasp and a plug may be received in a carburetor cavity each with an opening through which a limiter cap at least in part may be received. A head of a needle valve may be received in the carburetor cavity and may be rotatably disengaged from the cap when the cap is in its first position and engaged with the cap when in its section position for lesser rotation of the valve.

The clasp may have a one or more fingers with a free end engageable with a first shoulder of the limiter cap when in its first position to inhibit removal of the cap from the cavity and engageable with a second shoulder of the cap when in its second position to inhibit movement of the cap toward its first position.

BRIEF DESCRIPTION OF THE DRAWINGS

The following detailed description of exemplary embodiments and best mode will be set forth with reference to the accompanying drawings, in which:

FIG. 3 is an enlarged, cross-sectional view of a portion of FIG. 1 showing the ends of the needle valves and the limiter caps in a second assembly position;

FIG. 4 is an exploded perspective view of a needle valve and a limiter cap assembly and a special tool;

FIG. 8 is a front view of a second end of one of the needle valves shown in FIG. 1;

DETAILED DESCRIPTION

Figure 1:
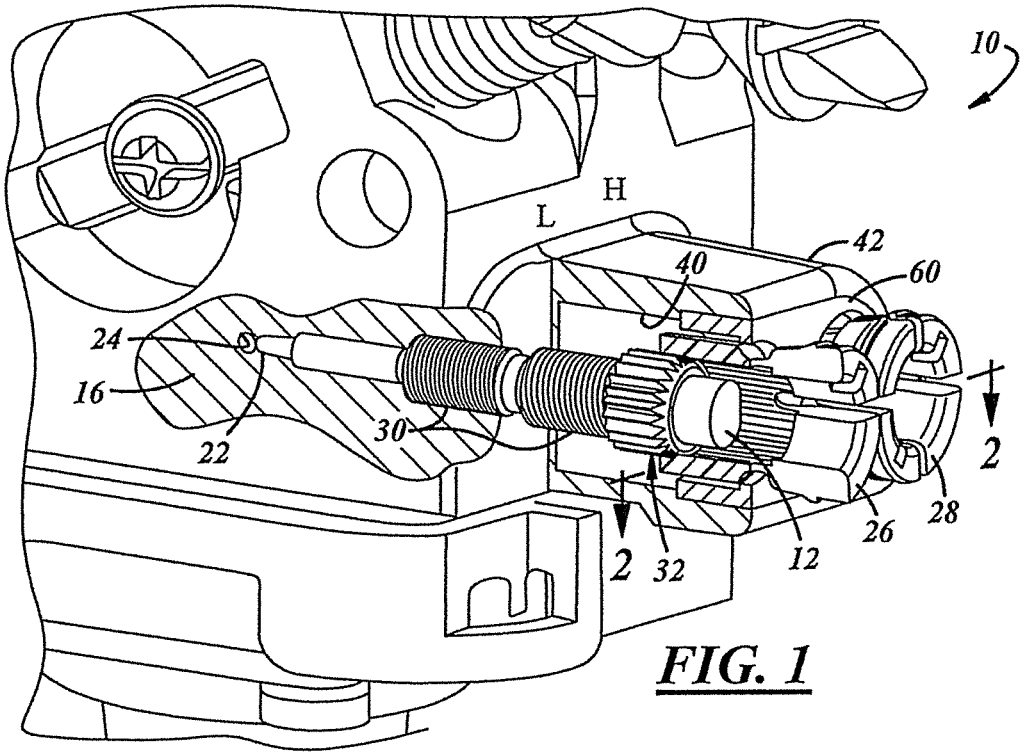
FIG. 1 is a fragmentary, perspective view of a carburetor having a pair of needle valves and showing limiter caps in a first assembly position, and with a portion broken away and in section to show a needle valve passage and a fuel passage of the carburetor.

Referring in more detail to the drawings, FIG. 1 shows a carburetor that provides a fuel and air mixture to an engine to support operation of the engine. The carburetor may be a diaphragm type carburetor, as shown, or any other air-fuel charge forming device suitable for use as described herein. The carburetor may be constructed and function as generally set forth in U.S. Pat. No. 4,752,420 which is incorporated herein by reference in its entirety. As will be described herein, the carburetor may have at least one adjustable valve for changing the amount or flow rate of fuel delivered from the carburetor and to the engine in an air and fuel mixture. An adjustment limiting device, sometimes called a limiter cap, may be coupled to the needle valve(s) to restrict or limit adjustment of the needle valve(s). Various implementations of the carburetor, needle valve, and limiter cap will be described hereafter.

Figure 2:
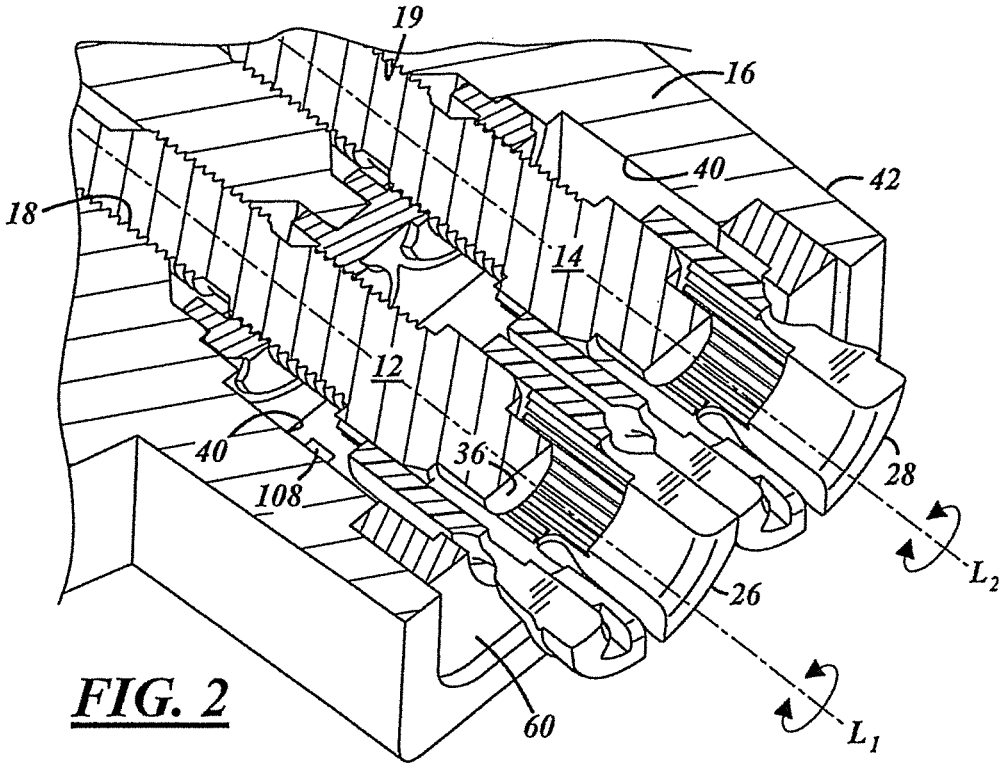
FIG. 2 is an enlarged, cross-sectional view of a portion of FIG. 1 showing the ends of the needle valves and the limiter caps in the first assembly position.

As illustrated in FIGS. 1-3, a carburetor 10 may include at least one valve 12 adjustable to control the air and fuel mixture ratio. A body 16 of the carburetor 10 may have at least one needle valve passage 18 for receiving the valve 12 (FIGS. 1 and 2, among others). In the implementation shown, the carburetor includes two needle valves 12, 14 rotatably carried by the carburetor body 16 about axes L1 and L2 (FIGS. 2 and 3), respectively; and the needle valves are located in separate needle valve passages 18, 19. The carburetor 10 may further include a recess or cavity 40 open to the passages 18, 19 and through which the needle valves 12, 14 are inserted into the passages. In at least some implementations, the cavity 40 may be defined at least partially in or by an outwardly extending projection or cover 42 and the cover 42 may surround at least part of the needle valves 12, 14. Rotation of the needle valves 12, 14 in one direction advances the needle valves further into the carburetor body 16 and rotation in the other direction retracts the needle valve from the carburetor body. Such rotation of the needle valves 12, 14 moves a tip 22 of the needle valve relative to a port or passage 24 through which fuel flows in the carburetor body 16 to control the flow rate of fuel through that port or passage. In the implementation shown, one needle valve 12 controls fuel flow through part of a low speed fuel circuit and the other needle valve 14 controls fuel flow through part of a high speed fuel circuit. Each needle valve 12, 14 may receive a limiter cap 26, 28 to control or limit the rotation of the valves and hence, adjustment of the flow rate of fuel through the respective fuel circuit in the carburetor 10.

As shown in FIGS. 1 and 2, the needle valves 12, 14 may be arranged generally parallel to each other, side-by-side, and may be rotated independently of each other through at least a portion of their adjustment range. Each needle valve 12, 14 may have the same features and so only one needle valve 12 will be further described.

As best shown in FIG. 4, the needle valve 12 may have a shank 20 extending from the tip 22 at a first end 34. The shank 20 may have one or more threaded portions 30 that engage complementary threads formed in the associated needle valve passage 18; e.g., the implementation shown has two threaded portions. A head 32 may extend from the shank 20 axially towards a second end 36 and a tool receiving feature 38 may be defined on or coupled to the head 32. The tool receiving feature 38 may permit rotation and adjustment of the valve 12. While other implementations are possible, the feature 38, may include a D-shaped projection (as shown). A special tool 50, e.g., in this case, a tool having a socket 52 complementarily shaped to the D-shaped projection, may receive the D-shaped projection for rotation of the needle valve 12 within the carburetor body 16. Of course, the tool receiving feature 38 may be formed in other desirable shapes, sizes, and orientations, and also may include recesses, cavities, slots, etc.

A peripheral surface 33 of head 32 may include one or more drive features 44 adapted to rotatably engage with the limiter cap 26. In the implementations shown, the drive features 44 include axially extending serrations; however, other implementations are also possible. Here, the serrations have an alternating sequence of V-shaped channels 47 and V-shaped ridges 48 (see also FIG. 8). The drive features 44 may be formed around all or only part of the head 32, and may be formed as discrete serrations and may be uniformly distributed or in spaced apart groups of serrations, as desired. The drive features 44 may be accessible from outside of the carburetor body 16 when assembled to facilitate assembly of the limiter cap 26 onto the valve 12, and to facilitate adjustment of the valve, as will be explained in greater detail below. The needle valve 12 further may include one or more shoulders 46 or other features adapted to provide or engage a seal within the carburetor body 16 to inhibit or prevent fuel leaking from the carburetor 10.

Returning to FIGS. 1-2, in the implementations where the carburetor body 16 includes the outwardly extending cover 42 and cavity 40 at least partially surrounding the needle valves 12, 14, a plug 60 may be provided in an open end of the cavity 40 to limit access to the needle valves 12, 14 (see also FIGS. 3, 5-7, and 12-13). The plug 60 may be a plate or merely part of the cover 42 and/or carburetor body 16. For example, where the plug 60 is a plate, the plug may be formed of metal, and may be press-fit, adhered, welded or connected by any other suitable means to the carburetor body 16, such as by crimping or deforming a portion of the end of the cover 42 or carburetor body material over the plate.

Figure 12:
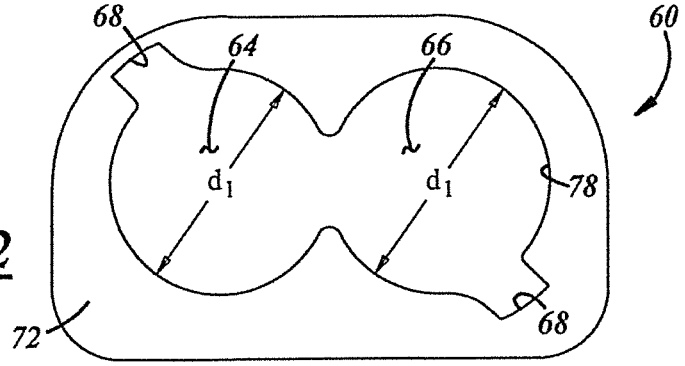
FIG. 12 is a front view of the plug.
Figure 13:
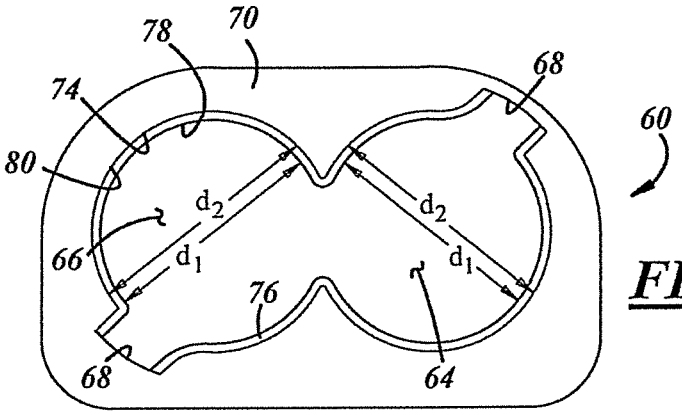
FIG. 13 is a rear view of the plug.

As best shown in FIGS. 12-13, the plug 60 may include an opening for each needle valve 12, 14, and is shown here as having two such openings 64, 66. The opening(s) may have a diameter $d_1$ and may be defined by an inner edge 78. Separate slots 68 may be provided in the plug 60 extending into each opening 64, 66. The slots 68 may be oriented circumferentially about their associated openings 64, 66 in any desired position. The plug 60 may have an inner surface 70 facing the carburetor body 16 (FIG. 13) and an outer surface 72 facing away from the body 16 (FIG. 12). The inner and outer surfaces 70, 72 may be generally flat and parallel to one another. The inner surface 70 may have one or more counterbores 74 coaxial with the opening(s); i.e., beneath the outer surface 72 of the plug 60, the openings 64, 66 may become wider or have a larger diameter $d_2$ over at least a portion of their circumference. One or more radially inwardly extending retention features or stop surfaces 76 may be provided at the counterbores 74 for retaining the limiter caps, as will be described in greater detail below. Such retention features 76 may extend inwardly from a counterbore sidewall 80 to the edge 78. The counterbore sidewall 80 may extend from the inner surface 70 towards the outer surface 72 defining the depth of the counterbore 74.

As shown in FIG. 3, the plug 60 may be adjacent to the limiter caps 26, 28 and may partially overly and retain the limiter caps, as set forth in more detail below. In the illustrated implementation, the limiter caps 26, 28 for the needle valves are identical; therefore, only one limiter cap 26 will be described herein. However, in other implementations, the limiter caps may be different.

Turning now to FIGS. 9, 10, and 11A-11C, the limiter cap 26 in at least one implementation may have a first or inner portion 90 and a second or outer portion 92. The limiter cap may be hollow with a passage or cavity extending axially therethrough, and have an open first end 94 adapted to be received over the head 32 of the needle valve 12 and an open second end 96 providing access to the head 32 within the cavity of the limiter cap (e.g., using the special tool 50). The inner portion 90 may axially extend from the first end 94 and be axially coupled to the outer portion 92; and the outer portion 92 may extend coaxially to the second end 96.

Figure 11A:
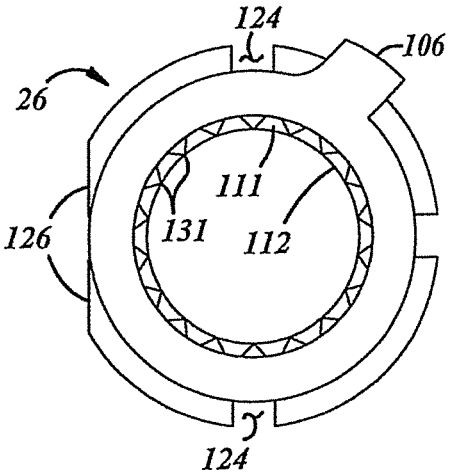
FIG. 11A is a rear view of the limiter cap viewed from a first end.
Figure 10:
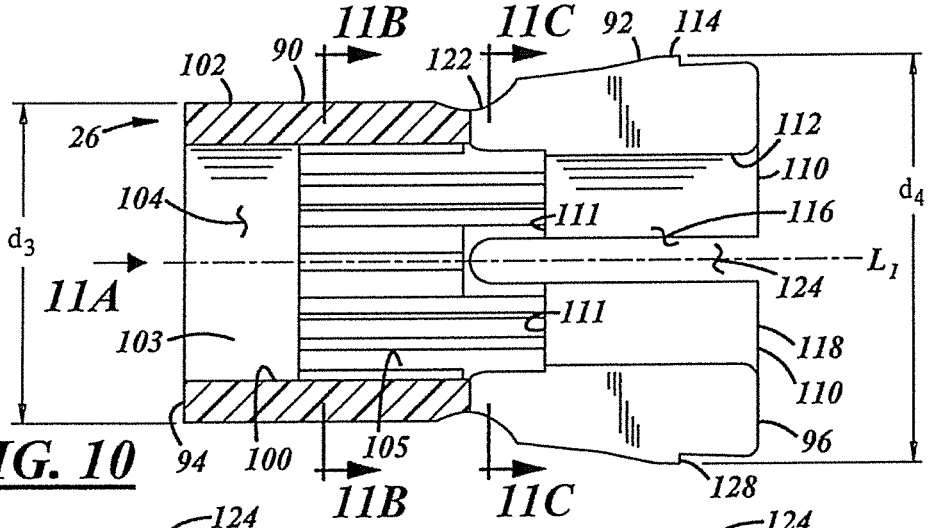
FIG. 10 is a cross-sectional view of the limiter cap.
Figure 11B:
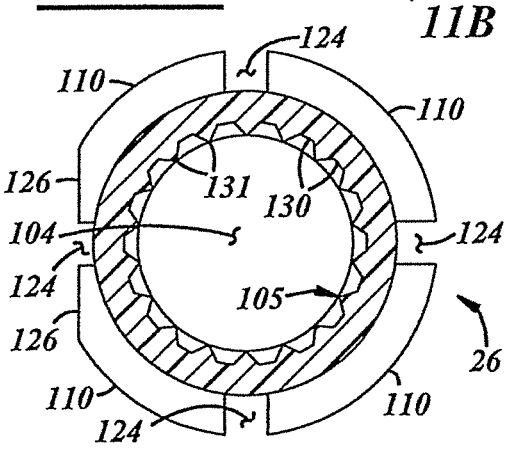
FIG. 11B is a cross-sectional view of the limiter cap shown in FIG. 10 along section lines 11B-11B.
Figure 11C:
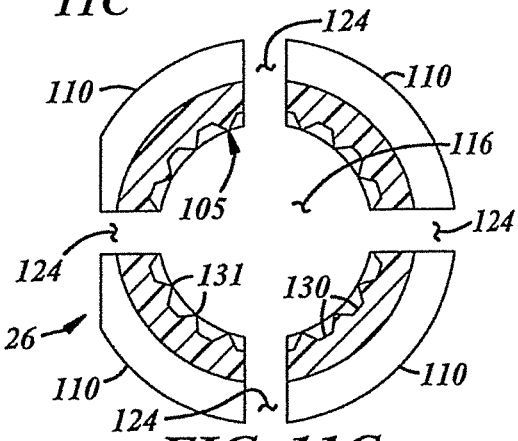
FIG. 11C is a cross-sectional view of the limiter cap shown in FIG. 10 along section lines 11C-11C.

The inner portion 90 may have a generally cylindrical wall 98 with generally cylindrical interior and exterior surfaces 100, 102 (FIG. 10). The interior surface 100 may define a first cavity 104 and have one or more axially extending driving features 105 which may be designed to mate with or otherwise engage the drive features 44 of the needle valve 12. In one implementation, the drive features 44 may be serrations that extend radially inwardly having an alternating sequence of flat channels 130 and V-shaped ridges 131 (e.g., FIG. 11A illustrates 18 channels and 18 ridges). The driving features 105 may be axially spaced from the first end 94 of the limiter cap having a slip surface 103 therebetween which may be generally smooth. It should be appreciated that other arrangements of serrations are possible. Furthermore, other driving features 105 are also possible and may vary according to the shape and size of the drive features 44.

An outer diameter $d_3$ of the exterior surface 102 of the inner portion 90 may be equal to or smaller or even slightly larger than the diameter $d_1$ of the opening 64 in the plug 60. The exterior surface 102 may have a rotation stop or tab 106 that extends axially along at least part of the exterior surface 102 of the inner portion and extends radially outwardly therefrom. The width of the tab and its radial length may be sized to fit through the slot 68 in the plug 60.

Turning now to the outer portion 92 (see also FIGS. 9-10, 11A-11C), the outer portion may be coupled to the inner portion 90 at a flex region 122, and may be generally comprised of a plurality of fingers 110 which may be located in a generally circular arrangement and which may axially extend towards the second end 96. The fingers 110 of the outer portion 92 may have an exterior surface 114 and an interior surface 112—the inner surface defining a second cavity 116 which is in communication with the first cavity 104 (of the inner portion 90). The fingers may be partially defined by a plurality of voids 124 with a void between each pair of adjacent fingers 110. The voids may contribute to the flexibility of the outer portion 92 (e.g., specifically, the fingers 110). In the illustrated implementation, four fingers 110 and four voids 124 are shown and each of the fingers are approximately the same size (however, other arrangements are possible). The fingers 110 may be thinner near the flex region 122 and may become thicker towards the second end 96 so that the greatest flexibility of the outer portion 92 is located at the flex portion 122. The fingers 110 in a first or at rest position, may be radially, outwardly inclined relative to the L1-axis having an outer diameter $d_4$ and may be flexible at least radially inwardly (e.g., flexing at the flex portion 122). As shown in FIG. 10, a shoulder 111 may be circumferentially defined along the interior surface 112 between the thinner and thicker sections.

The second cavity 116 may be generally frustoconical and sized to at least partially enclose the head 32 of the needle valve 12 during assembly. At least some of the driving features 105 of the first cavity 104 may extend into the second cavity 116; e.g., the serrations may extend past the flex portion 122 and onto the interior surface 112 of the fingers 110 with each finger having multiple channels 130. The total number of channels 130 and/or ridges 131 on the fingers 110 may be less than the total number of channels and/or ridges on the remainder of the interior surfaces 110, 112 of the limiter cap 26. This may be due to the presence of the voids 124, and because of the angular inclination of the fingers relative to the L1-axis (e.g., when the fingers 110 are flexed inwardly, the channels and ridges in the inner portion 90 may be may be aligned or coaxial to the L1-axis). Of course, other implementations are possible.

Figure 9:
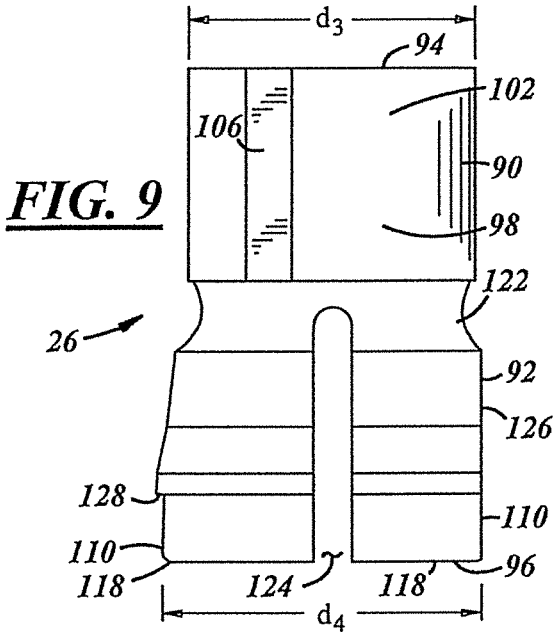
FIG. 9 is a side view of the limiter cap shown in FIG. 1.

One or more of the exterior surfaces 114 of the limiter cap 26 may also have an anti-rotation surface 126 or flat region (see, e.g., FIGS. 9 and 11A). In the implementation shown, two adjacent fingers 110 each have or collectively define the anti-rotation surface 126—the surfaces 126 on the fingers being generally coplanar with the other. The surfaces 126 may be radially located approximately 120 degrees from the tab 106 (on the inner portion 90); however, this is not required.

One or more of the fingers 110 may also have a lip 128 on the exterior surface(s) 114 spaced from the second end 96 for engagement with the retention feature 76 of the plug 60 during assembly (see FIGS. 9-10). In the illustrated implementation, the lip 128 is circumferentially located on all four fingers 110 and equally spaced from the second end 96 to provide a robust engagement with the retention feature 76. However in the implementation shown, the lip is absent at the anti-rotation surfaces 126.

At the second end 96 of the limiter cap 26, each finger may have an end 118; and some of the ends 118 may have an actuating feature 120 (e.g., see FIG. 6) adapted to receive a tool or other actuator in order to facilitate rotation of the limiter cap and needle valve assembly. In the illustrated implementation, the actuating feature 120 includes a pair of opposed grooves (or recesses or channels) that may extend outwardly from the inner surfaces 112 towards the exterior surfaces 114 of the fingers and may be of any suitable axial depth. Where the actuating feature 120 is a pair of opposed grooves, the tool or actuator may be a flat or common screwdriver (not shown). The grooves are shown by way of example, and other actuating features and tools are also possible. The limiter cap 26 may be formed of plastic, metal, or any other suitable material and may be formed in one-piece so that each described feature is integral to and formed in the one-piece, if desired.

Turning now to the assembly of the limiter caps and needle valves. Each needle valve 12, 14 may be inserted into its respective passage 18, 19 in the carburetor body 16 and rotated into a desired axial position relative to the fuel port or passage 24 to provide the desired fuel flow rate through that port or passage. This may be referred to as the calibrated position of the needle valves 12, 14 as that position may relate to the desired, calibrated fuel flow rate in the carburetor 10 under the initial assembly conditions (temperature, altitude, type of fuel used during calibration, etc). The calibrated position of one needle valve may not be the same as that of the other needle valve. For example, the differences in the calibrated positions may be attributable to one needle valve regulating the high-speed feel circuit and the other needle valve regulating the low-speed feel circuit. Or the ports could be at different locations within the carburetor body or the needle valves may be different lengths. Other reasons why the calibrated position may not be the same will be appreciated by skilled artisans. It is from this calibrated position that adjustment of the needle valves 12, 14 is limited by installation of the limiter caps 26, 28 onto the needle valves 12, 14.

After the installation of the needle valves, the plug 60 may be assembled in the cover 42 having the outer surface 72 facing outwardly. Therefore, the needle valves 12, 14 may only be accessed via the openings 64, 66 in the plug. Thereafter, the limiter caps 26, 28 may be assembled onto the needle valves, through the openings 64, 66 in the plug 60.

Since the limiter caps 26, 28 may have the same features, only one needle valve and limiter cap assembly will be further described, except where the assembly of two needle valves and two limiter caps necessitates additional explanation.

Figure 7:
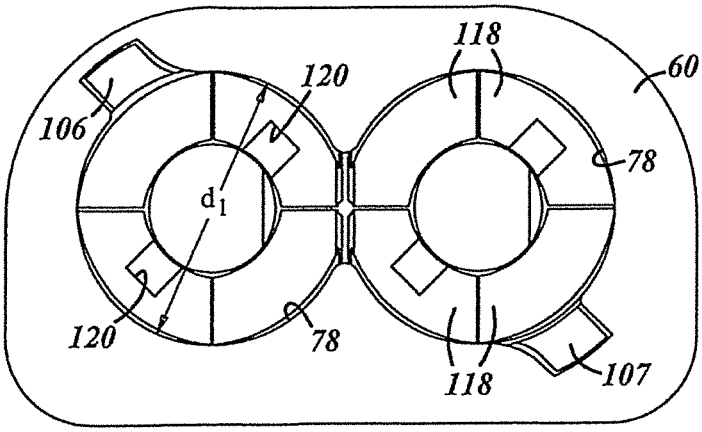
FIG. 7 is a front view of the plug and needle valves and showing the limiter caps in the second assembly position.

The limiter cap 26 may be assembled onto its associated needle valve 12 in multiple stages or positions enabling adjustment of the flow rate of the fuel during assembly; e.g., a first assembly position (see FIGS. 2 and 6) and a second assembly position (see FIGS. 3 and 7). In the first position, the inner portion 90 of the limiter cap is inserted through the opening 64 of the plug 60, and the needle valve head 32 is received into the first cavity 104 of the limiter cap 26 so that the drive features 44 of the head do not engage the driving features 105 on the inner surface 100 of the limiter cap. Instead, the head 32 may contact or be received radially within the limiter cap slip surface 103. In implementations having two needle valves, both limiter caps may be accordingly inserted with the flat regions 126 on the fingers 110 of their respective exterior surfaces 114 abutting one another thereby inhibiting rotation of the limiter caps in the first position. The tab 106 of the limiter cap may align with and be received in the slot 68 in the plug 60 further inhibiting rotation of the limiter cap 26. In this first position, the special tool 50 may engage the tool receiving feature 38 on the needle valve without interference of the limiter cap. Thus, the tool 50 may be used to calibrate the needle valve 12 with respect to the fuel port 124 in the carburetor body 16 by rotating the needle valve any number of turns or degrees without movement of or interference by the limiter cap 26. Following calibration, the limiter cap 26 then may be further axially advanced onto the needle valve 12 to the second position.

To advance the limiter cap 26 to the second position, the remainder of the limiter cap 26 may then be pressed (or press-fit) into and possibly completely through the plug opening 64. The diameter $d_4$ of the outer portion 92 may be greater than the diameter $d_1$ of the opening 64 of the plug 60 (see FIGS. 6-7). However, the outer portion 92 may be inserted or press-fit therethrough as the fingers 110 flex radially inwardly towards the L1-axis. Thus, both the inner portion 90 and outer portion 92 may be received within the opening 64 of the plug during assembly. The ends 118 of the fingers 110 may be pressed until they become flush with the outer surface 72 of the plug 60 or may be inserted beyond the outer surface 72 thereof. For example, the fingers 110 may be pressed until they pass beyond the retention feature 76 of the plug 60. Due to the elastic nature of the fingers 110, they may slightly or partially expand outwardly once the lip 128 passes the retention feature 76 so that the plug radially overlaps the lip 128, and the limiter cap 26 is thereby positively located or locked therein to prevent withdrawal of the limiter cap 26 through the opening 64.

As the outer portion 92 enters the opening 64 and the fingers begin to flex inwardly, the driving features 105 in the second cavity 116 of the outer portion 92 may begin to similarly engage the drive features 44 on the head 32 of the needle valve 12. Upon engagement of the driving features 105, the shoulder 111 may radially overlap one end of the head 32 to limit insertion of the cap 26 into the cavity and also to inhibit or prevent access to the drive features 44 on the head 32.

Figure 14:
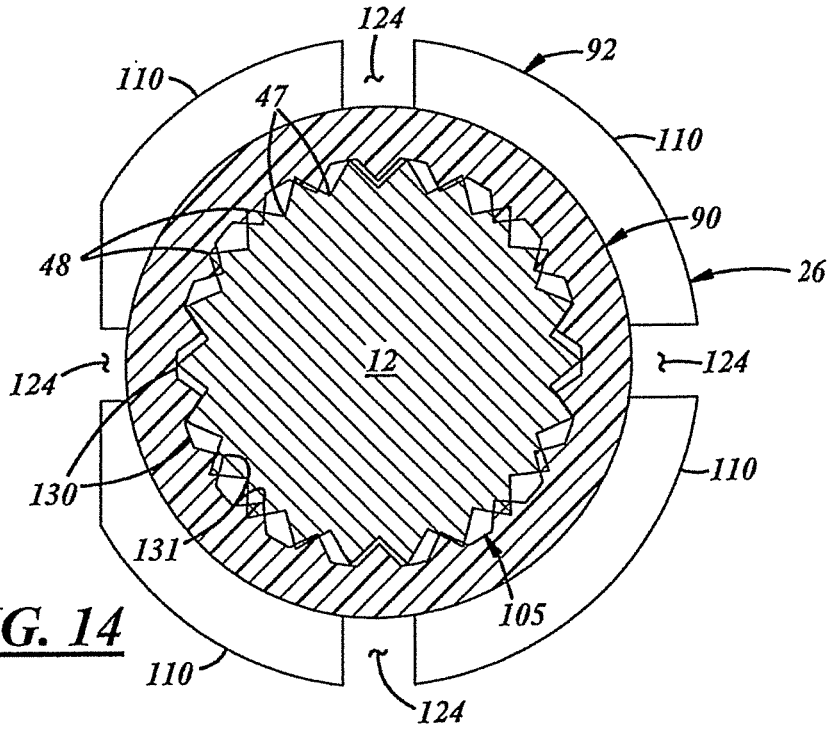
FIG. 14 is a cross-sectional view of one of the needle valve and limiter cap assemblies shown in FIG. 3 along section lines 14-14.

When the limiter cap 26 is press-fit on the head 32 of the needle valve 12, at least some of the driving features 105 of the limiter cap may align with the drive features 44 of the needle valve. In some implementations, for example, for each serration on the limiter cap, there may be a complementary serration on the needle valve (e.g., a 1:1 serration arrangement or an even-serration ratio); and in some instances, this may provide a secure friction fit. In at least one implementation, only some of the limiter cap serrations may align with the needle valve serrations. For example, FIG. 14 illustrates the needle valve 12 and limiter cap 26 with some serrations aligned and some serrations intentionally misaligned (e.g., an uneven-serration ratio). In this example, the driving features 105 may be made of a softer material and deform around the drive features 44 of the needle valve. This arrangement has at least two advantages. This may increase the integrity of the previously described friction or interference fit. In addition, the needle valve may not rotate during installation of the limiter cap—e.g., in a 1:1 serration arrangement, the needle valve may rotate slightly as the limiter cap 26 is advanced; this slight rotation may negatively influence the calibration. Thus, a 1:1 serration arrangement with or without deformation may effect a rotation of more than 7 degrees (even possibly 7 to 10 degrees or more). In at least one implementation of an uneven serration arrangement having flat channels 130, the needle valve may rotate less than 7 degrees (including not at all or 0 degrees) during advancement of the limiter cap, and a rotation of 0-7 degrees may not significantly or adversely influence the calibration. In at least some implementations, the needle valve may rotate less than 3 degrees (including not at all or 0 degrees) during advancement of the limiter cap.

During insertion of the limiter cap 26 through the opening 64, the tab 106 on the inner portion 90 may advance past the plug 60 into the cavity 40 of the carburetor. In this second position, the tab 106 may no longer be restricted by the slot 68 (in plug 60), and a rotation limiter 108, such as an inwardly extending tab or stop surface, located within the cavity 40 may engage the tab 106 as the limiter cap at an end of a permitted range of rotation to limit the needle valve rotational range to (or within) a predetermined angular range. More than one stop surface may be provided in the carburetor body, if desired, or on an adjacent limiter cap or other surface to constrain rotation of a limiter cap in both directions of rotation.

Other implementations of the stops and tabs are also possible. For example, in the second position, the rotation of the needle valve and limiter cap assembly may also be inhibited by the tabs 106 and 107 of the first and second limiter caps, respectively, in dual valve carburetors. For example, the needles valves 12, 14 could be positioned relatively close together so that the tab 106 on limiter cap 26 interferes with the tab 107 on limiter cap 28, thus limiting rotation of one or both of the limiter caps 26, 28 and their associated needle valves 12, 14. In other words, the adjacent limiter caps may engage each other to limit their rotation, and hence, the rotation of their associated needle valves.

When the limiter cap is in the second position, the needle valve may be rotatable to a lesser degree or extent than when the limiter cap is in the first position. Also, the distance between the inner surfaces of the fingers 110 may be small enough to inhibit or prevent the special tool 50 from engaging the tool receiving feature 38. More specifically, the thicker section(s) of the finger(s) may reduce or eliminate the gap between the inside surface(s) 112 of the fingers 110 and at least part of the tool receiving feature 38 so that the tool 50 cannot engage or actuate the feature 38. In the implementation shown (e.g., FIG. 3), the fingers 110 may not radially overlap or cover the receiving feature 38, however, in some implementations they could. Even though the receiving feature 38 is not accessible, the actuating feature 120 in the limiter cap 26 located near the ends 118 of the fingers 110 may be reachable or accessible (e.g., to the manufacturer or end-user). Accordingly, even though the needle valve 12 may no longer be rotated using the tool receiving feature 38, the actuating feature 120 may allow limited rotation of the needle valve 12 and the limiter cap 26 together within the predetermined range of rotation of the limiter cap, thus permitting limited user adjustment of the needle valve 12.

The advancement of the limiter caps 26, 28 from the first position to the second position may be performed by different entities, manufacturers, etc. For example, the flex region 122, the slip surface 103, the plug 60, and/or various other features of the carburetor and needle valve assembly may be capable of retaining the limiter cap(s) in the first position; i.e., such features may prevent them from falling out or off the carburetor during shipping. This may permit a first manufacturer or entity to ship the carburetor with the limiter caps in the first position to a second manufacturer or second entity). The second manufacturer may then rotate or adjust the needle valves to a desired calibration and then advance the limiter caps to the second position.

The afore-described limiter cap designs inhibit an end-user from adjusting the fuel flow rate beyond predetermined limits or settings to avoid problems with engine performance and to control emissions from the engine with which the carburetor is used. Initial needle valve calibration can be controlled by a manufacturer or someone that assembles the carburetor onto an engine and then the limiter caps may be advanced to their second positions to limit further adjustment of the needle valves. Further adjustment of the needle valve assembly in the second position is generally reserved for the end-user and constrained within a predetermined angular range. The limiter cap design provides the actuating feature 120 so that the end-user may use a tool (e.g., a flathead screwdriver) to tune the fuel flow and thereby control to a limited degree the fuel-to-air ratio or mixture.

Figure 5:
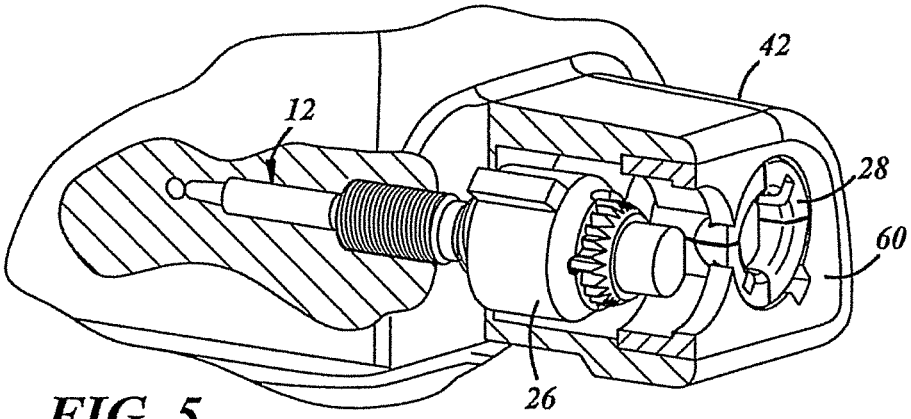
FIG. 5 is a fragmentary, perspective view of the carburetor showing the pair of needle valves and limiter caps in the second assembly position with the fingers of one of the limiter caps removed.
Figure 6:
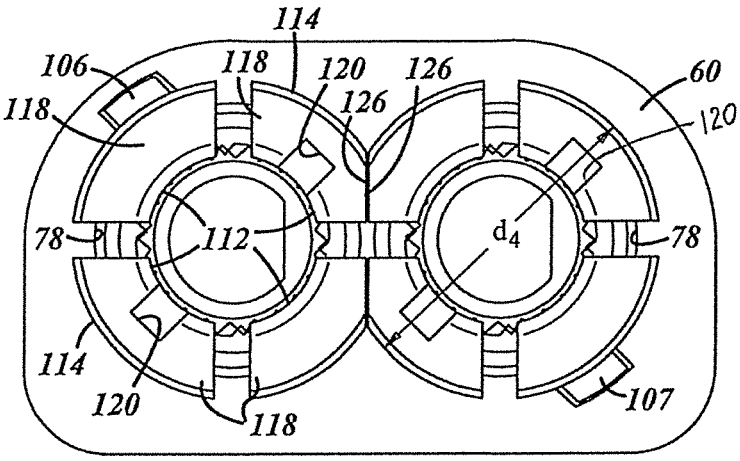
FIG. 6 is a front view of a plug and needle valves and showing the limiter caps in the first assembly position.

However, the tool receiving feature 38 is not intended to be accessed by the end-user (e.g., who receives the carburetor with the limiter caps 26, 28 in the second position; e.g., the fingers 110 block access to the feature 38 so that the special tool 50 cannot engage the feature 38). However, if the end-user attempts to access the tool receiving feature 38, the fingers 110 may break off above the inner portion 90 (e.g., at the weaker flex region 122; see FIG. 5 showing the limiter cap 26 with the fingers 110 broken off or removed); thus, the limiter caps are tamper-resistant. Despite one or more fingers breaking, the inner portion 90 may remain in place and intact; furthermore, the tab 106 may still engage with the rotation limiter 108 and the drive features 105 on the limiter cap 26 will still be engaged with the driving features 44 on the needle valve. Thus, the range of rotation will still be limited to the delimited range (or that range available by adjusting the actuating feature 120). Therefore, any or all of the following elements may serve as tamper resistant features: the driving features 105, the tab 106, the fingers 110, and the flex region 122.

The term end-user as used herein includes a purchaser or consumer of any small engine or small engine machines having the carburetor 10 therein. End-users may also include mechanics and other service or repair personnel.

Other carburetor and limiter cap implementations exist allowing the manufacturer to coarsely calibrate or tune the needle valve(s) and allowing the end-user to finely calibrate or tune the needle valve(s) while still inhibiting the end-user from tampering with the coarse calibration. One such additional implementation is a barrel-type limiter cap as shown in FIG. 15 and is described below (in FIG. 15, the carburetor body 16 and the cover 42 are hidden).

In the barrel-type limiter cap implementation, many of the same features and components are illustrated, and like reference numbers and designations in the various drawings indicate like elements, and like elements will not be fully re-described here.

Figure 15:
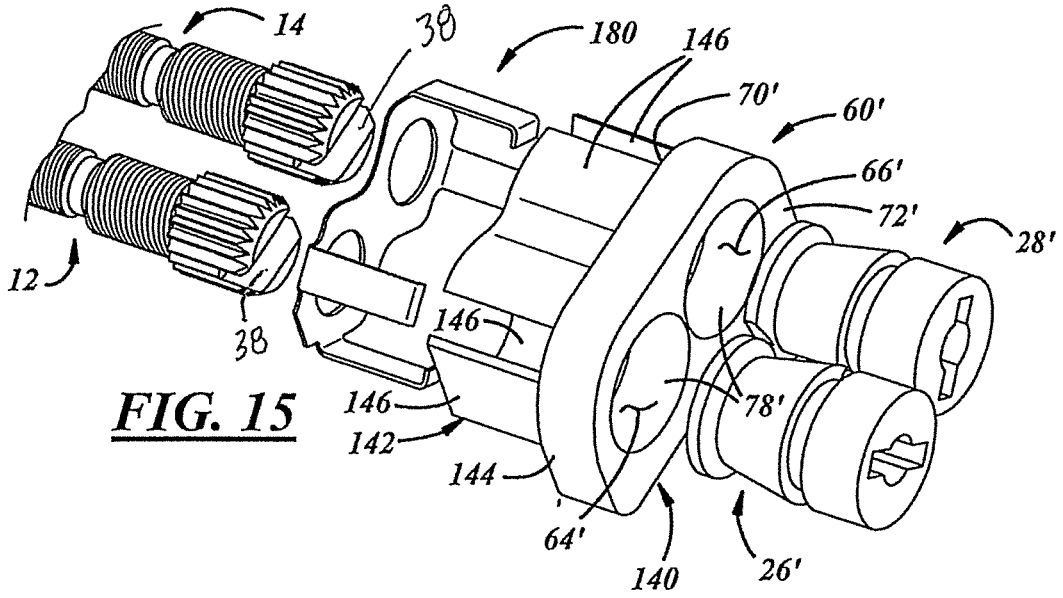
FIG. 15 is an exploded perspective view of a limiter cap, clasp and plug for a pair of needle valves.

FIG. 15 illustrates the barrel-type limiter caps 26', 28' with the needle valves 12, 14, a clasp 180, and a plug 60' in a disassembled or exploded state. The needle valves 12, 14 may be identical to those previously described and may be sized to fit within the carburetor body 16 and at least partially within the cavity or projection 40. In FIG. 15 and the illustrations that follow, the needle valves are identical except that the tool receiving feature 38 is shown as a slot (e.g., for receiving a straight screw driver) instead of a D-shaped end. The plug 60', the clasp 180, and the limiter caps 26', 28' will each be discussed in turn below.

As shown in FIG. 15, the plug 60' includes a plate member or base 140 coupled to a sheath section 142. The base 140 may have an inner surface 70' and an outer surface 72'. The shape of the base 140 may be defined by an outer edge 144 and may be sized to fit within the cavity 40 of the carburetor, as described with respect to the limiter cap 26. The base may have a first opening 64' and a second opening 66' for receiving the limiter caps 26', 28', respectively. Here, the openings 64', 66' are illustrated as circular defined by an inner edge 78'.

Figure 16A:
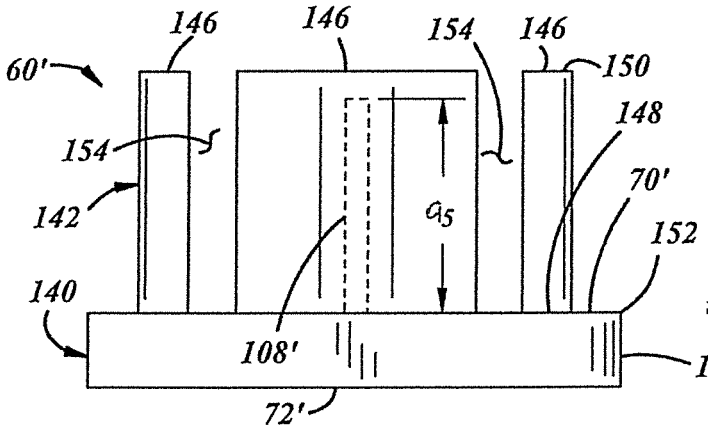
FIG. 16A is a top view of the plug.
Figure 16B:
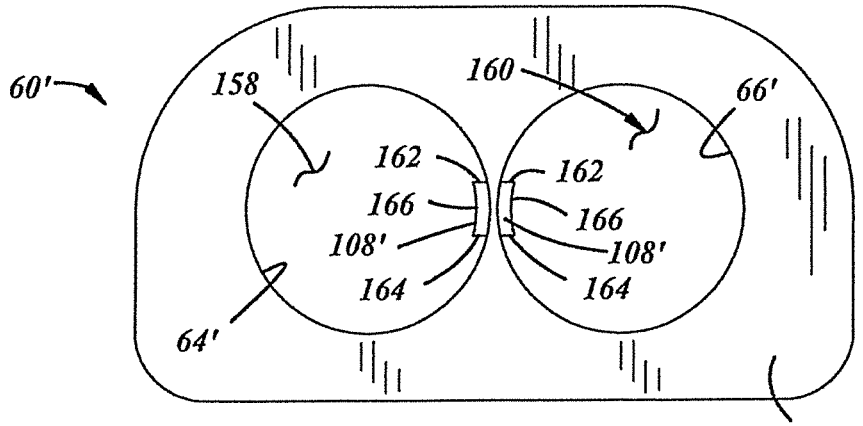
FIG. 16B is a front view of the plug shown in FIG. 16A.

Turning to FIG. 16A, there is illustrated a top view of the plug 60'. The sheath section 142 extends outwardly from the inner surface 70' and is located inwardly from a shoulder 152 which is defined by the edge 144. The sheath section 142 may include one or more walls 146 extending from the base 140 to define two axially extending cavities 158, 160 aligned with the openings 64' and 66'. The walls or sections thereof may be separated by axially extending gaps 154 and may have a first end 148 extending from the base 140 and a second or free end 150 not attached to the base. A partition wall 156 may extend between the openings 64' and 66' (also shown in FIG. 21 and in section in FIG. 18C) and with the other walls defines the two cavities—a first cavity 158 and a second cavity 160 (see FIG. 16B). The first cavity 158 may be in communication with the opening 64' and may be generally cylindrical. Likewise, the second cavity 160 may be in communication with the opening 66' and may be generally cylindrical.

A rotation limiter 108' may extend from the partition wall 156 inwardly into the first cavity 158 and may also extend into the second cavity 160. The rotation limiter 108' may be a generally rectangularly shaped projection extending at least a portion of the axial length of the partition wall 156 (illustrated as $\alpha_5$ in FIG. 16A). And in the implementation shown in FIG. 16B, two side surfaces 162, 164 may extend radially inwardly into each respective cavity from the partition wall 156 each having a guide surface 166 therebetween; here, the guide surface 166 is illustrated as concave (although other shapes, including a flat surface, are possible). In one exemplary implementation, the limiter 108' does not extend to the front surface 72' of the base 140, nor does it extend to the second ends 150 of the walls 146 (see e.g., FIG. 16A). The gaps 154 between the walls 146 may be sized to receive portions of the clasp 180, as will be described below.

Figure 17A:
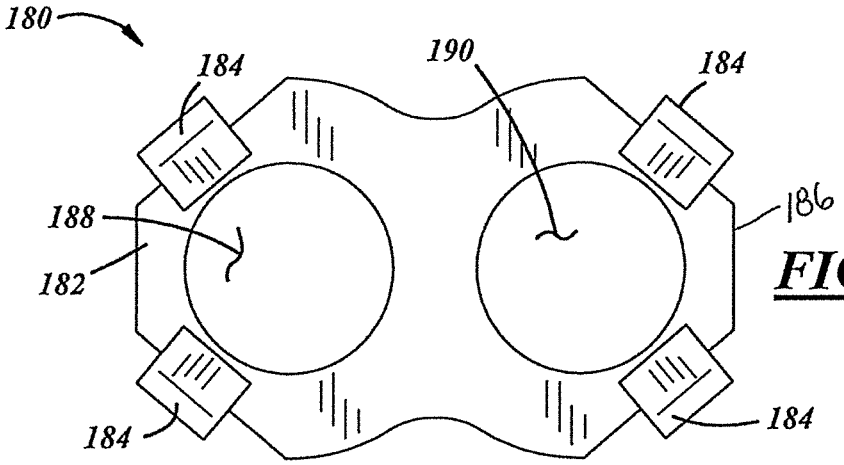
FIG. 17A is a front view of the clasp.
Figure 17B:
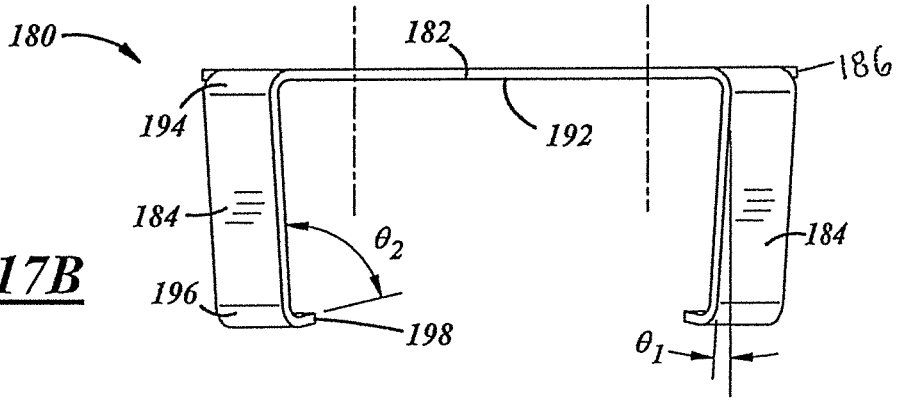
FIG. 17B is a top view of the clasp shown in FIG. 17A.

FIG. 17A is a front view of the clasp 180. The clasp 180 may include a plate member or base 182 and four legs 184 extending therefrom. The base 182 may be defined by a peripheral edge 186 and may also be sized to fit within the cavity 40 and cover 42 of the carburetor 10 (previously illustrated). The base 182 may have two openings therethrough—a first opening 188 and a second opening 190. The openings 188, 190 may be generally circular and may be sized to receive a portion of the needle valves 12, 14, respectively, therethrough. The legs 184 may be connected at a first end to the base near the peripheral edge 186 and extend generally axially from the base 182 to a free end. As best shown in the top view of FIG. 17B, the legs 184 may be inclined radially so that the free ends of the legs are closer to each other than are the first ends. The legs in FIG. 17B are shown inwardly inclined at an angle $\Theta_1$. Each of the legs 184 may be coupled to the base 182 at a flex region 194. A retention feature 196 may be located at or near each the free ends 198 of the legs 184. The illustrated retention features 196 are feet bent inwardly at the ends 198 of the legs 184. The feet are oriented at a bend angle $\Theta_2$ (FIG. 17B). In at least one implementation, $\Theta_1+\Theta_2$ may be at least 90°. Other implementations of the retention feature are possible (such as a hook, a pin, a ridge, etc.).

Figure 18A:
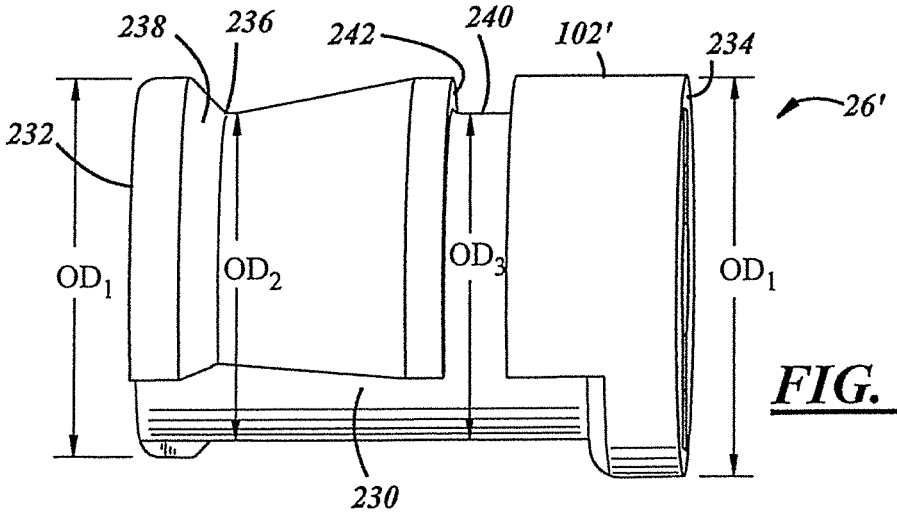
FIG. 18A is a side view of one of the limiter caps shown in FIG. 15.

The limiter caps 26' and 28' may be identical so only one will be described herein. FIG. 18A illustrates a side view of the limiter cap 26' shown in FIG. 15. The limiter cap 26' includes a generally cylindrical or barrel-shaped body 230 having a number of contours along an exterior surface 102' and having a first end 232 and a second end 234 each having a first outer diameter ($OD_1$). The body 230 may have a circumferential groove 236 at a second outer diameter ($OD_2$) spaced inwardly from the first end 232 (e.g. between the ends 232, 234 and closer to the first end 232). A first shoulder or first retaining surface 238 may be located between the first end 232 and the circumferential groove 236 and extends radially outwardly relative to the groove. The body 230 may also have a channel 240 having a third outer diameter ($OD_3$) located between the groove 236 and the second end 234. In the illustrated example, the outer diameter of the body 230 gradually increases from the circumferential groove 236 to a second shoulder or second retaining surface 242 at the channel 240; the diameter of the body 230 at the second shoulder 242 may be equivalent to $OD_1$.

Figure 18C:
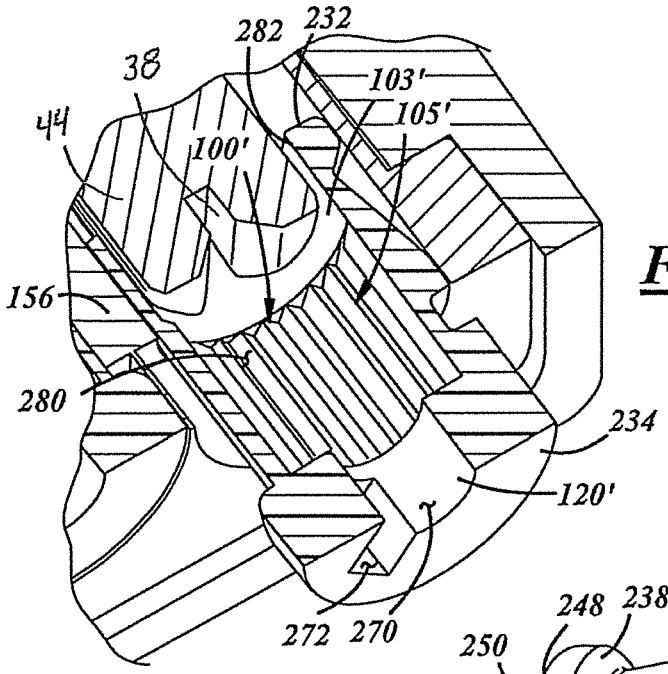
FIG. 18C is a cross-sectional, perspective view of the limiter cap shown in FIG. 18A.
Figure 18B:
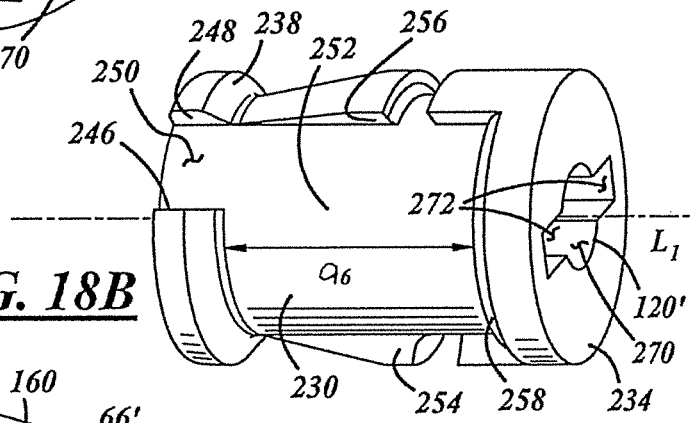
FIG. 18B is a perspective view of the limiter cap shown in FIG. 18A.

As best viewed in FIG. 18B, which illustrates a perspective view of the limiter cap 26' in a second position, the first shoulder 238 may have an installation notch 250 therein; i.e., the shoulder 238 may not extend entirely circumferentially about the body 230. The radial depth of the notch 250 may be equivalent to the difference between the first and third outer diameters. The notch 250 may be defined by a first inwardly facing edge 246 and a second inwardly facing edge 248 at the ends of the shoulder 238. The spacing of the edges 246, 248 may be sized to receive the rotation limiter 108' on the plug 60' (i.e., the arcuate or circumferential spacing between the edges 246, 248 may be at least slightly greater than the spacing between the edges 162, 164 of the rotation limiter 108').

FIG. 18B also illustrates a rotation region 252; the rotation region 252 is an exterior surface on the body 230 having an outer diameter approximately equivalent to the third outer diameter. The rotation region 252 is defined by two oppositely facing rotation stops 254, 256, the first shoulder 238, and a third shoulder 258 which is spaced inwardly from the second end 234 (axially closer to the second end 234 than the channel 240) and faces the first shoulder. The stops 254, 256 extend axially and radially outwardly, and the shoulders 238, 258 extend circumferentially and radially outwardly. In at least one implementation, the circumferential angular span or range between the rotation stops 254, 256 (as measured from the imaginary axis L1') may be between 60° and 110°, although other ranges may be used including lower or higher limits or both for the angular range. The axial spacing between the first and third shoulders 238, 258 ($\alpha_6$) may be greater than or equal to the axial length of the rotation limiter 108' (i.e., $\alpha_6 \geq \alpha_5$). An actuating feature 120' may be located at or in the second end 234 of the limiter cap 26'. Here, the actuating feature 120' is illustrated as a circular opening 270 having two slots 272 extending from opposing sides of the opening 270, collinear to one another; however, other implementations of the actuating future 120' are also possible.

In FIG. 18C, a perspective, cross-sectional view of the limiter cap 26' is shown. As in the limiter cap 26 arrangement previously described, the limiter cap 26' has a cavity 280 therein which is generally cylindrical as defined by an interior surface 100'. The cavity 280 extends from an opening 282 at the first end 232 of the limiter cap 26' towards the second end 234 and is in communication with the opening 270 and slots 272 of the actuating feature 120'. The interior surface 100' includes a slip surface 103' near the first end 232 and driving features 105' which extend from the slip surface 103' towards the second end 234. The slip surface 103' and the driving features 105' may be similar to the slip surface 103 and driving features 105 previously described. For example, they may include the flat channel and ridges previously described; furthermore, where the driving features 105' are serrations (as illustrated), the ratio of driving features 105' to the drive features 44 on the needle valve 12 may be a 1:1 ratio or may be an uneven ratio, as previously described.

Figure 19:
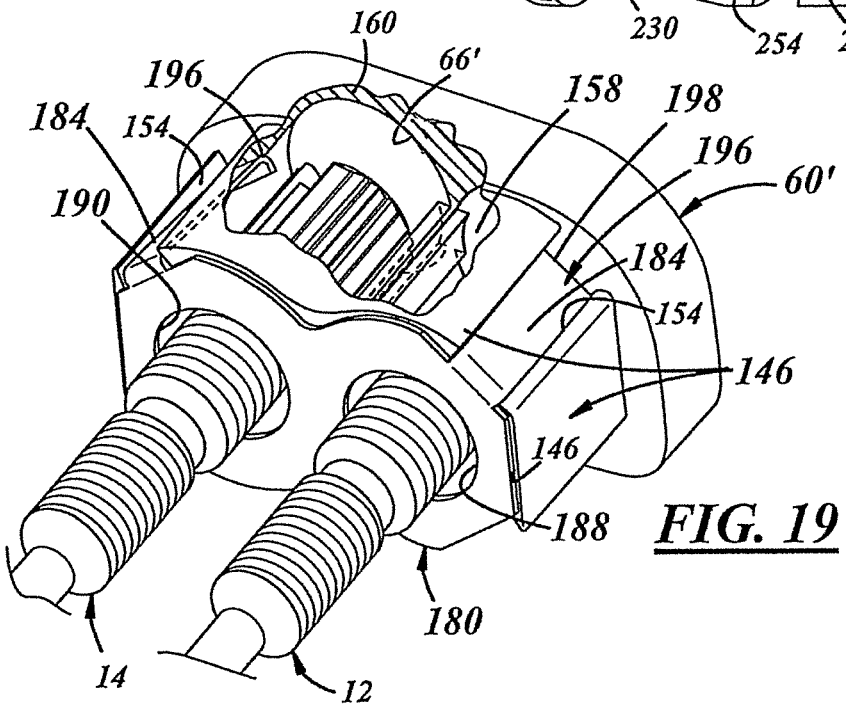
FIG. 19 is a rear perspective view of the pair of needle valves shown in FIG. 15 with a portion of the plug broken away.

During the installation and/or assembly of the carburetor, the needle valves 12, 14, clasp 180, and the plug 60' may be first located within the carburetor body 16. FIG. 19 illustrates a rear perspective view of this assembly (the carburetor 10 and its cover 42 being hidden). In some implementations, the needle valve 12, 14 may be assembled into the carburetor body before the clasp and plug (in other embodiments, they may be assembled together or afterwards). After locating the needle valves in their respective passages 18, 19, the clasp 180 may be inserted into the cavity, and then the plug may be inserted into the cavity and mated with the clasp, or the clasp may be coupled to the plug 60' and together the two components may be located in the carburetor body cavity 40 (the heads 32 of the needle valves passing through the openings 188, 190 of the clasp 180). The manner of locating the plug 60' in the cavity and securing it to the cover 42 may be similar to the means and methods previously described (e.g., with respect to plug 60). As shown in FIG. 19, the four legs 184 of the clasp are located within the four gaps 154 of the plug 60' and the base 182 is spaced from the base 140 by the legs 184, and the base 182 of the clasp 180 engages one or more walls of the plug 60'. Since the legs 184 are canted radially inwardly, the retention features 196 near the distal ends 198 of the legs may extend beyond the gaps 154 between the walls 146 and into the first and second cavities 158, 160 of the plug 60'—each in a nominal position.

Figure 20A:
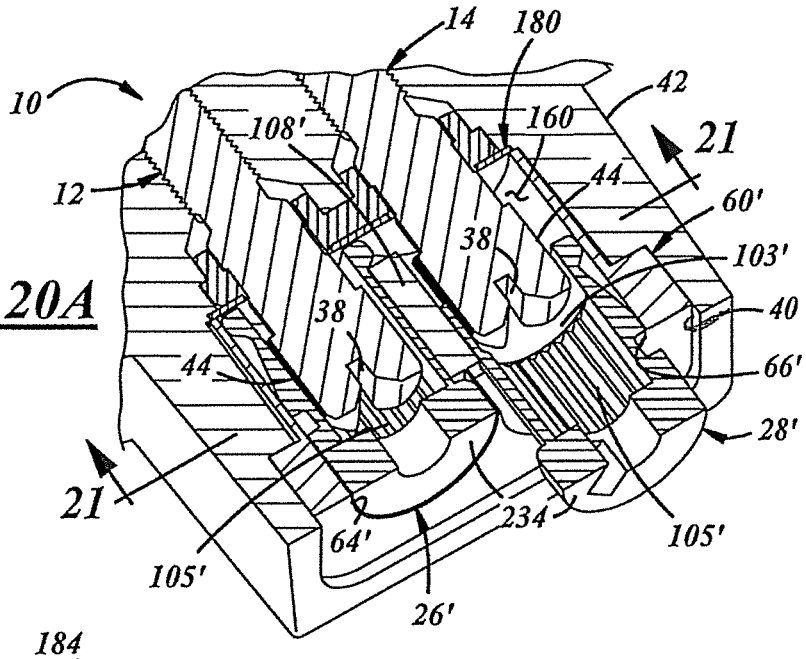
FIG. 20A is a fragmentary, cross-sectional perspective view of the needles valves and limiter cap assembly installed on a carburetor, illustrating one limiter cap in a first assembly position and another limiter cap in a second assembly position.
Figure 20B:
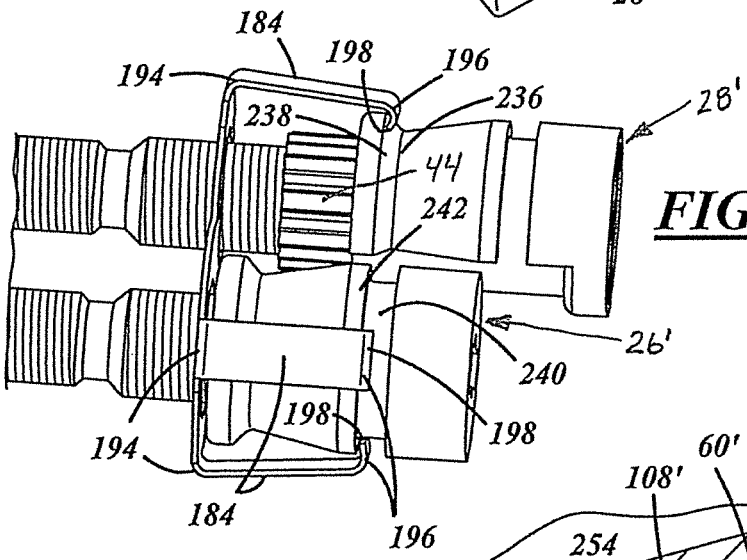
FIG. 20B is a fragmentary, perspective view of the limiter caps and clasp in the positions shown in FIG. 20A with the plug removed to show the engagement of the clasp with the limiter caps.

Once the plug 60' and the clasp 180 are located within the carburetor, the limiter caps 26', 28' may be located therein. FIGS. 20A and 20B illustrate the limiter cap 28' in a first position and the limiter cap 26' in a second position. The assembly of the limiter caps 26', 28' into the carburetor 10 may be identical.

FIG. 20A is a partial cross-sectional view of the carburetor illustrating the clasp 180 and the plug 60' received in the carburetor cavity 40. The limiter caps may be received through the openings 64', 66' in the plug 60' so that the second ends 234 face outwardly. The limiter caps (e.g., 28') may be received when the assembly notch 250 is aligned with the rotation limiter 108' extending into the second cavity 160 of the plug 60' (and the notch of limiter cap 26' may be similarly aligned with the rotation limiter 108' in the first cavity). The limiter cap 28' is in the first position when the limiter cap's first shoulder 238 is inserted beyond the retention features 196 of the clasp's legs 184 (see also FIG. 20B). Due to the flexible and resilient nature of the legs 184, the distal ends 198 of the legs 184 move radially outwardly as the shoulder passes the ends 198. Once the first shoulder 238 of the limiter cap moves beyond the retention features 196, the retention features may then elastically return to their nominal (or nearly nominal) position, and the retention features overlie the first shoulder 238 to retain the limiter cap 28' in this position (as best shown in FIG. 20B). Removal of the limiter cap is inhibited by the retention features, and by engagement of the clasp base 182 with one or more walls of the plug 60'. As shown in FIG. 20A, in the first position the driving features 105' of the limiter cap 28' have not engaged with the drive features 44 on the needle valve 14; i.e., the drive features 44 are adjacent to the slip surface 103' allowing relative rotation between the needle valve and limiter cap 28'.

When the limiter cap is advanced to the second position, the driving features 105' may engage the drive features 44 of the needle valve 12, as shown with respect to limiter cap 26'. Additionally, as the limiter cap 26' is advanced to the second position (as best shown in FIG. 20B), the distal ends 198 of the legs 184 may move radially outwardly again flexing at the flex regions 194 until the second shoulder 242 of the limiter cap passes the retention features 196 on the legs 184. Upon reaching the second position, the retention features 196 may again elastically return to their nominal (or nearly nominal) position and becoming located within the channel 240 on the limiter cap and overlying the second shoulder 242 to limit axial movement of the limiter cap 26'.

As previously described with respect to the limiter cap 26, the assembly of the limiter caps may occur in two different locations or by two different entities (manufacturers, assemblers, etc). For example, a first manufacturer may assemble the needle valves 12, 14, the plug 60', the clasp 180, and the limiter caps 26', 28' into the carburetor body 16 with the limiter caps 26' and 28' in the first position (either with or without calibration) and then deliver the carburetor to a second entity to perform calibration (or additional calibration of the needle valves).

Regardless of where the calibration takes place, with the limiter caps in the first position, the needle valves may be rotated relative to the limiter caps and over a wide and generally unrestricted angular range for initial calibration. The range of rotation of the needle valve(s) in the first position will not be limited as the drive features 44 have not engaged with the driving features 105' of the limiter cap. Where the limiter caps 26', 28' implement the illustrated actuating feature 120', a tool may be inserted through the opening 270 to perform the calibration.

Figure 21:
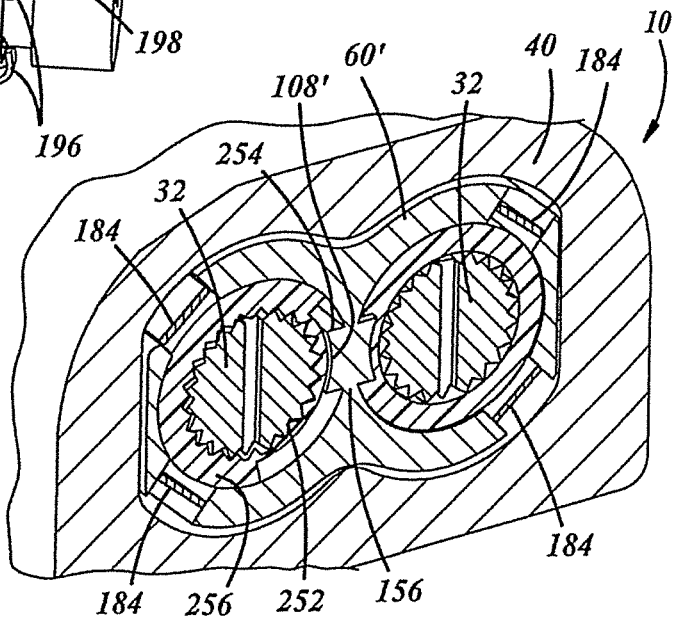
FIG. 21 is a fragmentary, cross-sectional perspective view taken along section lines 21-21 in FIG. 20A.

Once the limiter caps are moved into the second position, only fine tuning of the needle valves may occur—using the actuating feature 120', typically by an end-user (but others also may fine tune). When the limiter caps are moved to their second position (e.g., such as the limiter cap 26' shown in FIG. 20A), the limiter caps are not rotatable independently of the needle valve as the driving features 105' have engaged the drive features 44 of the needle valve. Lastly, the limiter cap 26' may only rotate within the angular bounds of the rotation region 252; i.e., if the rotation region is 90°, then any fine tuning or calibration of the needle valve will be limited to 90° of a rotation of a needle valve. As illustrated in FIG. 21, when an attempt is made to exceed the angular bounds of the rotation region, the rotation stop 254 or 256 may engage the rotation limiter 108' preventing further rotation (e.g., in FIG. 21, rotation stop 254 bears against the rotation limiter 108').

The limiter caps 26', 28' may be tamper resistant as well. As previously described, the engagement of the driving features 105' with the needle valve's drive features 44 serves to inhibit rotation of the needle valves independent of the limiter caps. And for example, damage or even removal of portions of the second end 234 of the limiter cap will not allow an end-user a greater angular range of rotation of the needle valve—i.e., despite such tampering, the range of rotation will still be bound by the tamper resistant features or rotation stops 254, 256.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

Furthermore, spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The invention claimed is:

1. A carburetor, comprising:

a body having a fuel passage formed therein, and a first needle valve passage communicating with the fuel passage;

a first needle valve received in the first needle valve passage for rotation about an axis, having a tip movable relative to a portion of the fuel passage to control the flow rate of fuel in the passage, a head having one or more drive features formed thereon, and a tool engaging feature by which the needle valve may be rotated; and a first limiter cap installed on the first needle valve, having at least one driving feature engageable with at least one drive feature on the first needle valve, having a first position permitting rotation of the first needle valve relative to the first limiter cap and a second position permitting a lesser range of rotation of the first needle valve than the first position, the first limiter cap having at least one tamper resistant feature that retains the lesser range of rotation after tampering, wherein the first needle valve has a plurality of serrations which define the at least one drive feature of the first needle valve and the first limiter cap has a plurality of serrations which define the at least one drive feature of the first limiter cap, and wherein at least one serration on the first limiter cap is not aligned with a space between two adjacent serrations on the first needle valve when the first limiter cap is advanced axially onto the first needle valve from the first position to the second position and the at least one serration on the first limiter cap is deformed upon installation of the first limiter cap on the first needle valve.

2. The carburetor of claim 1 wherein the first limiter cap is advanced axially onto the first needle valve from the first position to the second position and in the second position at least one drive feature of the first limiter cap is engaged with at least one drive feature of the first needle valve to prevent relative rotation between the first needle valve and the first limiter cap.

3. The carburetor of claim 2 wherein when the first limiter cap is advanced axially from the first position to the second position, the first needle valve rotates less than 9 degrees.

4. The carburetor of claim 1 wherein the serrations of the first limiter cap are formed from a softer material than are the serrations of the first needle valve.

5. The carburetor of claim 4 wherein the first limiter cap has multiple serrations that are circumferentially misaligned relative to serrations of the first needle valve and the first limiter cap has multiple serrations that are circumferentially aligned relative to serrations of the first needle valve such that some of the serrations of the first limiter cap are received between two serrations of the first needle valve and some of the serrations of the first limiter cap are engaged and deformed by a serration of the first needle valve.

6. The carburetor of claim 1 wherein the at least one tamper resistant feature includes a rotation limiting feature on an exterior surface of the first limiter cap.

7. The carburetor of claim 6 wherein the rotation limiting feature is a rotation region defined in part by two rotation stops that limit the rotation of the needle valve to the lesser range of rotation in the second position.

8. The carburetor of claim 6 wherein the rotation limiting feature is a tab for engaging a stop within the body of the carburetor.

9. The carburetor of claim 1 further comprising a second needle valve received in a second needle valve passage of the carburetor having a second limiter cap installed thereon, wherein the second limiter cap is installed in a first position and a second position, the second position of the second limiter cap permitting a lesser range of rotation of the second needle valve than the first position.

10. The carburetor of claim 9 wherein the first and second limiter caps each have an anti-rotation surface which are adjacent to one another when the first and second limiter caps are inserted into their respective first positions.

11. A carburetor, comprising:

a body having a fuel passage formed therein, and a first needle valve passage communicating with the fuel passage;

a first needle valve received in the first needle valve passage for rotation about an axis, having a tip movable relative to a portion of the fuel passage to control the flow rate of fuel in the passage, a head having one or more drive features formed thereon, and a tool engaging feature by which the needle valve may be rotated; and a first limiter cap installed on the first needle valve, having at least one driving feature engageable with at least one drive feature on the first needle valve, having a first position permitting rotation of the first needle valve relative to the first limiter cap and a second position permitting a lesser range of rotation of the first needle valve than the first position, the first limiter cap having at least one tamper resistant feature that retains the lesser range of rotation after tampering, wherein the at least one tamper resistant feature includes one or more flexible fingers that define a cavity, the flexible fingers being defined in part by voids between adjacent flexible fingers with the voids extending through the first limiter cap, and wherein the voids permit the flexible fingers to move relative to each other so that the volume of the cavity decreases when the first limiter cap is advanced axially onto the first needle valve from the first position to the second position inhibiting access to the first needle valve.

12. The carburetor of claim 11 wherein the lesser range of rotation is not increased by removal of the one or more flexible fingers.

13. The carburetor of claim 11 which also includes a plug adapted to be received within a cavity of the body and having an opening having a diameter, and wherein the flexible fingers each have an exterior surface and collectively the exterior surfaces of the flexible fingers define an outer diameter that is larger than the diameter of the opening prior to movement of the fingers as the first limiter cap is advanced axially onto the first needle valve from the first position to the second position, and when the first limiter cap is advanced axially onto the first needle valve the exterior surfaces of the flexible fingers engage the plug and the flexible fingers are displaced radially inwardly until the diameter of defined by the exterior surfaces of the flexible fingers is equal to the diameter of the opening.

14. The carburetor of claim 13 wherein the exterior surface of at least one flexible finger includes a flat region.

15. The carburetor of claim 13 wherein the plug includes a radially inwardly extending retention surface and the first limiter cap includes a radially outwardly extending lip that overlaps the retention surface when the first limiter cap is installed.

* * * * *